US009617806B2

(12) United States Patent
Fey et al.

(10) Patent No.: US 9,617,806 B2
(45) Date of Patent: Apr. 11, 2017

(54) DOWNHOLE TOOL SUPPORT STAND, COMBINATIONS, AND METHODS

(71) Applicant: Gordon Fey, Beaumont (CA)

(72) Inventors: Gordon Fey, Beaumont (CA); Toni Fey, Beaumont (CA)

(73) Assignee: Gordon Fey, Beaumont (CA)

( * ) Notice: Subject to any disclaimer, the term of this patent is extended or adjusted under 35 U.S.C. 154(b) by 345 days.

(21) Appl. No.: 14/280,514

(22) Filed: May 16, 2014

(65) Prior Publication Data

US 2015/0330164 A1 Nov. 19, 2015

(51) Int. Cl.

| | |
|---|---|
| ***E21B 19/18*** | (2006.01) |
| ***E21B 19/00*** | (2006.01) |
| ***E21B 19/16*** | (2006.01) |

(52) U.S. Cl.

CPC ..... *E21B 19/18* (2013.01); *E21B 19/00* (2013.01); *E21B 19/16* (2013.01)

(58) Field of Classification Search

CPC ..... E21B 19/18; E21B 12/00

See application file for complete search history.

(56) References Cited

U.S. PATENT DOCUMENTS

| | | | | |
|---|---|---|---|---|
| 1,507,294 A * | 9/1924 | Mercer | E21B 3/02 | 173/145 |
| 2,076,810 A | 4/1937 | Deckard | | |
| 2,563,913 A * | 8/1951 | Binney | E21B 10/06 | 173/140 |
| 2,661,188 A * | 12/1953 | Smoot | E21B 19/18 | 248/624 |
| 2,972,388 A | 3/1961 | Thornburg | | |
| 3,030,889 A | 4/1962 | Parker | | |
| 3,157,286 A | 11/1964 | Gyongyosi | | |
| 3,378,067 A | 4/1968 | John | | |
| 3,493,061 A | 2/1970 | Gyongyosi | | |
| 3,533,478 A * | 10/1970 | Tissier | E21B 7/124 | 173/160 |
| 4,441,432 A | 4/1984 | Carlton | | |
| 4,474,498 A | 10/1984 | Smith | | |
| 4,974,686 A * | 12/1990 | Hisey | E21B 19/20 | 166/77.53 |

(Continued)

FOREIGN PATENT DOCUMENTS

| | | | |
|---|---|---|---|
| DE | 102012216917 A1 * | 3/2014 | E21B 17/04 |
| WO | 2007093212 | 8/2007 | |

OTHER PUBLICATIONS

Tilting Motorized Rotary Table: Tormach; <<http://www.tormach.com/store/index.php?app=ecom&ns=prodshow&ref=31848>>; May 5, 2014.

(Continued)

*Primary Examiner* — Shane Bomar

(74) *Attorney, Agent, or Firm* — Pedersen and Company, PLLC; Ken J. Pedersen; Barbara S. Pedersen

(57) ABSTRACT

A method of connecting a downhole tool and a downhole tubular: positioning the downhole tool coaxially on a rotatable seat; and rotating the seat to thread the downhole tool to the downhole tubular. A support stand: a structural frame with ground engaging members; and a downhole tool seat mounted for rotation on the structural frame about an axis of rotation, the downhole tool seat being coaxial with the axis of rotation. A combination of the support stand of and a downhole tool on the seat.

17 Claims, 2 Drawing Sheets

(56) References Cited

U.S. PATENT DOCUMENTS

| | | | | |
|---|---|---|---|---|
| 5,885,145 | A | 3/1999 | O'Mara | |
| 6,010,299 | A | 1/2000 | Jesswein | |
| 6,386,283 | B1 | 5/2002 | Mosing | |
| 7,062,991 | B1 * | 6/2006 | West | E21B 19/18 81/57.16 |
| 7,814,971 | B2 | 10/2010 | Jones | |
| 8,281,867 | B2 | 10/2012 | Belik | |
| 8,444,097 | B2 | 5/2013 | Morrow | |
| 8,863,846 | B2 * | 10/2014 | Overstreet | E21B 19/086 166/338 |
| 2005/0051682 | A1 | 3/2005 | Tuohy | |
| 2006/0054331 | A1 * | 3/2006 | Hawkins, III | E21B 19/18 166/380 |
| 2010/0071958 | A1 | 3/2010 | Bienfang | |
| 2010/0230115 | A1 | 9/2010 | Belik | |
| 2012/0234601 | A1 * | 9/2012 | Griffin | E21B 19/18 175/57 |
| 2015/0159446 | A1 * | 6/2015 | Pop | E21B 19/18 269/310 |
| 2015/0218897 | A1 * | 8/2015 | Jost | E21B 17/04 166/380 |

OTHER PUBLICATIONS

Airframe (tripod) jacks, Integrated Publishing; <<http://navyaviation.tpub.com/14018/css/14018_145.htm>>; May 5, 2014.

1 Ton Drum Lift: Princess Auto; <<http://www.princessauto.com/pal/en/Repair-Equipment/1-Ton-Drum-Lift/8270753.p>>; Apr. 29, 2014.

Float Shoe Information: Schlumberger; <<http://www.glossary.oilfield.sib.com/en/Terms.aspx?LookIn=term%20name&filter=float%20shoe>>; Apr. 8, 2014.

Larin Jack Stand: Mills Fleet Farm; <<http://www.fleetfarm.com/detail/larin-jack-stands-3-ton-1-pair/0000000001564>>; Apr. 8, 2014.

Casing Operations Information: Occupational Health and Safety Administration; <<https://www.osha.gov/SLTC/etools/oilandgas/drilling/casing.html>>; May 5, 2014.

Tilting Rotary Tables: CNC Indexing; <<http://www.cncindexing.com/tilt-rotary-tables.html>>; Apr. 29, 2014.

Tripod Hydraulic Jack, Integrated Publishing; <<http://navyaviation.tpub.com/14018/css/14018_145.htm>>; May 5, 2014.

* cited by examiner

DOWNHOLE TOOL SUPPORT STAND, COMBINATIONS, AND METHODS

TECHNICAL FIELD

This document relates to downhole tool support stands, combinations, and methods.

BACKGROUND

On a drilling rig at a well site, a float shoe may be installed to a well tubular as follows. First, the float shoe is lifted up by several individuals or by hoist onto an upside-down milk crate or five gallon bucket. Next, the drawworks on the mast are used to lower the well tubular down to at or near the level of the float shoe. Next, the float shoe is hand-threaded onto the well tubular. Finally, the float shoe is torqued to the well tubular with power or hand tongs, and the well tubular and float shoe inserted into the well. Alternatively, the float equipment may be installed in the horizontal position by a bucking operator off site.

SUMMARY

A method of connecting a downhole tool and a downhole tubular, the method comprising: positioning the downhole tool coaxially on a rotatable seat; and rotating the seat to thread the downhole tool to the downhole tubular.

A support stand comprising: a structural frame with ground engaging members; and a downhole tool seat mounted for rotation on the structural frame about an axis of rotation, the downhole tool seat being coaxial with the axis of rotation.

A combination comprising the support stand of and a downhole tool on the seat.

In various embodiments, there may be included any one or more of the following features: Prior to rotating, securing the downhole tool to the seat. The downhole tool is secured to the seat with one or more locks. Unlocking the downhole tool to release the downhole tool. During rotating, the downhole tubular is suspended above the seat from a rig mast at a well. The seat is mounted for rotation on a structural frame. Jacking up the seat relative to the structural frame. The frame has a base with ground engaging members. The ground engaging members rest on a working surface adjacent a well bore in the working surface, the downhole tubular is suspended above the well bore, and further comprising tilting at least the seat relative to the working surface and toward the downhole tubular. Tilting comprises tilting the structural frame by jacking up one or some of the sides of the base. Tilting comprising rocking the downhole seat relative to the structural frame. Positioning the downhole tool on the seat further comprises lifting the downhole tool onto the seat using a hoist. The seat is defined at the base of a cage basket, the cage basket having a sidewall, the locks comprising radial clamps positioned in the sidewall. A lock for securing a downhole tool on the downhole tool seat. An anchor jack mounted to or adjacent a side of the structural frame to tilt the structural frame. The downhole tool seat is supported on the structural frame to rock to a varying degree about the structural frame. The downhole tool seat is supported to rock using one or more spring elements. The downhole tool seat is formed at the base of a cage basket, the cage basket having a sidewall, with radial clamps positioned in the sidewall. The structural frame comprises a tripod. A jack between the downhole tool seat and the structural frame.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIG. 6 is taken along the view lines 6-6 in FIG. 1, but with the jack and anchor jack removed.

DETAILED DESCRIPTION

Immaterial modifications may be made to the embodiments described here without departing from what is covered by the claims.

During well drilling, servicing, completion, workover, intervention production, or other situations, a tubing string may be assembled and run into a well. A tubing string may be constructed of one or more well tubulars, such as jointed, coil, and casing tubing in some cases. The tubing string provides a conduit through which the oil or gas will be produced from a wellbore, or through which other fluids (like cement) will flow. Well tubulars may include tubing joints (individual lengths of jointed tubing), which are generally within a common range of lengths and have a thread connection on each end. The specification of the tubing material, geometry of the tubing, and design of the connection thread may be selected to suit the reservoir fluid and wellbore conditions.

Various tools or accessories may be connected to the tubing string to perform various functions. For example, sensors, reamers, float equipment, centralizers, tubing anchors, packers, jars, accelerators, perforators, and other tools may be added. Some tools are positioned at the terminal downhole end of the tubing string, and some may be positioned at intermediate locations in the tubing string depending on application.

Downhole tools tend to be made from a solid block of steel that is machined into a desired shape and may include additional components typically also comprising steel. Other rugged materials or metals may be used for construction of such tools, and various components and materials added to give the tool its desired functionality. It is common to hand-position and hand-thread such tools into connection with a well tubular or other portion of the tubing string. Once hand threaded into place, power tongs or hand operated tongs or wrenches may be used to torque up the joint. The resulting weight of such tools may make it difficult and in some cases dangerous for rig hands to manually install the tools to a tubing string.

Various safety precautions may be taken to ensure the safety of rig workers installing such tools. For example, as casing is being run, accessories such as centralizers, scratchers, guide shoe, and a float collar may be installed into the tubing string. The special service supervisor may hold a pre-job meeting with the special service crew and other involved personnel to review responsibilities and to coordinate the operations to be performed. Potential hazards to personnel in such situations include: a) dropping a guide shoe or float collar onto legs or foot, b) getting fingers pinched between tools and casing tongs when manually moving a guide shoe or float collar, c) back strain, and d) exposure to hazardous materials, especially thread lock compounds. Some solutions employed to address such hazards include using a winch, air hoist, or other powered equipment to handle downhole tools.

Figure 1:
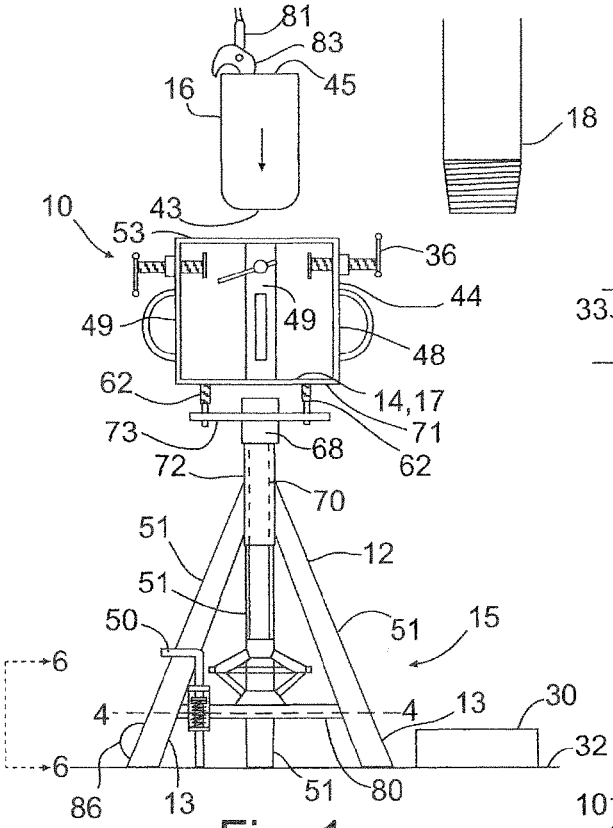
FIGS. 1-3 are a sequence of side elevation views illustrating the installation of a float shoe to a well tubular using the support stand of FIG. 1.
Figure 1A:
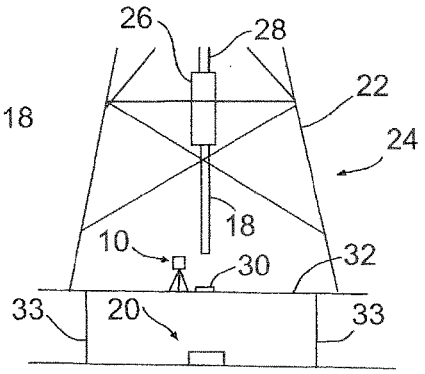
FIG. 1A is a side elevation view of a drilling rig, well tubular, and support stand, positioned over a well.

Referring to FIGS. 1 and 1A, a support stand 10 for connecting a downhole tool 16 to a downhole tubular 18 is illustrated. Referring to FIG. 1, the support stand 10 has a structural frame 12 and a downhole tool seat 14. Structural frame 12 may include a base 15 with ground engaging members 13, for example attached to or as part of legs 51 extended from a central hub 72. Hub 72 may define an apex upon which the seat 14 rests or extends from. The apex need not be the highest point on the frame 12. A number of cross braces 80 may extend between adjacent legs 51 at the base 15 for reinforcement or housing additional components as will be discussed elsewhere in this document. Braces 80 function as reinforcing ribs. Legs 51 may be of suitable cross-sectional dimensions, including I-beam, box, or L-shape. Structural frame 12 may comprises a tripod, for example if three legs 51 are used. In other cases four or more legs are provided.

Figure 2:
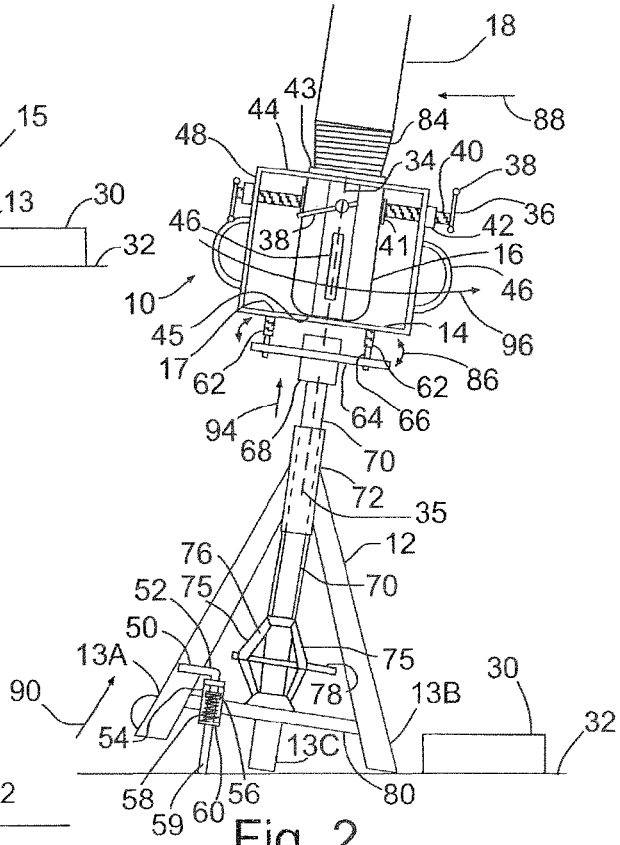

Referring to FIG. 2, seat 14 may be mounted for rotation on the structural frame 12, for example about an axis of rotation 34. The seat 14 in the example shown is a portion of an upper surface of a plate 17, the portion defining the position where the tool 16 is placed on plate 17 during use. The seat 14 is coaxial with the axis of rotation 34. Thus, a tool 16 mounted on seat 14 will rotate coaxially with the seat 14 when the seat 14 is rotated. In the example shown axis 34 may thus represent an axis of rotation of seat 14 as well as a central axis of tool 16 positioned on the seat 14. Referring to FIG. 1 the seat 14 may be formed at the base, such as circular plate 17, of a cage basket 44. The cage basket 44 may have a sidewall 48. In other cases basket 44 may have a solid sidewall. In the example shown the sidewall 48 is defined by a series of radially spaced vertical slats 49 about plate 17, the slats 49 connected to an upper ring 53. Although plate 17 defines seat 14 as having a planar shape in the example shown, other shapes of seat 14 may be used, including a concave shape centered over axis 35, or a shape configured to mate with a first end 43 of tool 16. Projections (not shown) may be positioned on plate 17 to align tool 16 coaxial with axis of rotation 34. In some cases seat 14 may be defined by a chuck with jaws (not shown) for aligning and locking tool 16 on seat 14.

Referring to FIG. 1, seat 14 may be mounted on structural frame 12 in a suitable fashion. For example, a spindle or axle 70 may depend from a back side 71 of plate 17, axle 70 fitting within hub 72 of frame 12. Axle 70 may extend from a collar 68 mounted on a plate 73 supporting seat 14 by one or more springs 62. Referring to FIG. 2, in the example shown springs 62 are axially and laterally flexible columns that support seat 14 on the structural frame 12 to permit seat 14 to rock to a varying degree about the structural frame 12. Such is an example of seat 14 being located on a second portion of a two portion attachment mounted on structural frame 12, the first portion including the axle 70 and being mounted for rotation to structural frame 12, the first and second portions being flexibly connected together to permit relative rocking. Permitting the seat 14 to rock or tilt allows for fine adjustment of the axis of rotation 34 of seat 14 relative to an axis of rotation 35 of axle 70 about structural frame 12. The arrangement shown functions like a ball joint, because axes 34 and 35 may be angled relative to one another during rotation of seat 14, yet both axes define axes of rotation. In addition, the springs 62 permit relative axial movement between seat 14 and plate 64, thus permitting fine adjustments of the position of the tool 16 relative to the tubular 18. Other suitable rocking mechanisms may be used instead of or in addition to springs 62, for example corresponding concave and convex surfaces, a ball joint, a universal joint, and others. Springs 62 may be mounted on respective bolts 66 or other support columns extended from plate 64.

A lock, such as one or more radial clamps 36 may be included in stand 10. Referring to FIG. 2, the lock may secure a downhole tool 16 on the downhole tool seat 14, for example using radial clamps 36 positioned in the sidewall 48. Radial clamps 36 may include a handle 38, a bolt 40, and an end plate 41, mounted for lateral advancement and retreat within a nut 42 fixed to sidewall 48. Thus, once tool 16 is positioned on seat 14 clamps 36 may be advanced by rotating handles 38 to contact and center tool 16 upon seat 14. Other locks may be used, such as wire clamps, lateral jaws, chains, ropes, and magnets.

Figure 4:
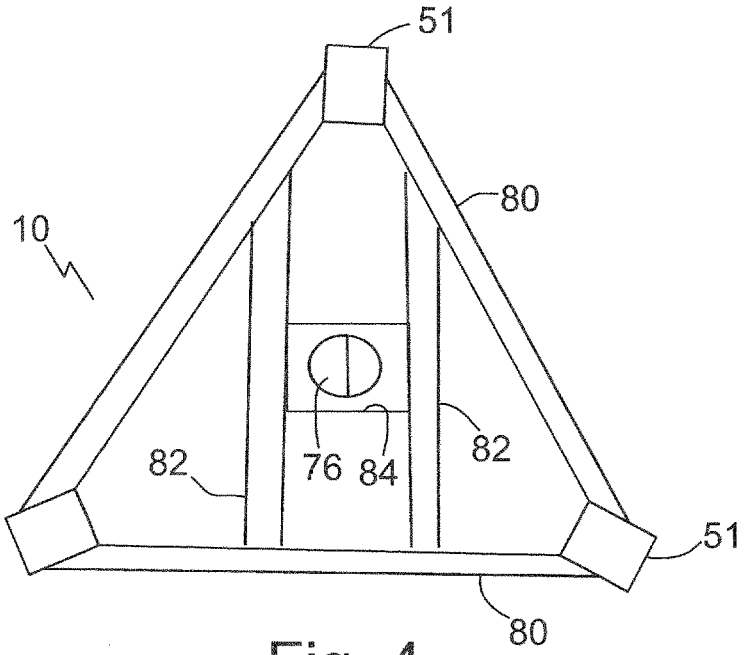
FIG. 4 is a section view taken along the section line 4-4 in FIG. 1.

Referring to FIG. 2, a jack 76 may be between the downhole tool seat 14 and the structural frame 12. Referring to FIGS. 2 and 4, the jack 76 may be mounted directly on the structural frame 12, for example on cross beams 82 connected to braces 80 between legs 51. In other cases the jack 76 may be mounted on the first portion of the basket assembly, for example between the axle 70 and the seat 14. Referring to FIGS. 1 and 2, either way the jack 76 moves the seat 14 axially relative to the structural frame 12, for example in the direction shown by arrow 94. Referring to FIGS. 1 and 2, jack 76 is a scissor jack. A threaded bolt 78 may be rotated, for example with a removable lever (not shown) inserted into an aperture in an end of the bolt) to close scissor arms 75 to exert an axial force upon axle 70 in the example shown. Scissor jacks and other mechanical jacks are useful for example in cold weather because they retain functionality, unlike some hydraulics, and are inherently safer to use than hydraulic pistons, which can drop upon a sudden leakage of hydraulic fluid. Mechanical jacks also tend to function in cold temperatures better than do hydraulics. Axial positioning with jack 76 permits rough adjustment of the positioning of end 43 of tool 16 relative to threaded end 84 of tubular 18. Jack 76 may be a suitable jacking device, including a hydraulic pump, screw jack, or other suitable mechanism.

Referring to FIG. 2 an anchor jack 50 may be mounted to or adjacent a side, for example a side defined by leg 13A, of the structural frame 12. Anchor jack 50 has a ground engaging member 59 that contacts a working surface 32 to tilt the structural frame 12 relative to the working surface 32. To achieve such a goal anchor jack 50 may have a drive axis defined by drive rod 52, the drive axis being offset from an axis, such as central axis 35, of the structural frame 12. Axis 35 may define a center of gravity, such that an axial force offset from the axis 35 will cause tilting.

Figure 5:
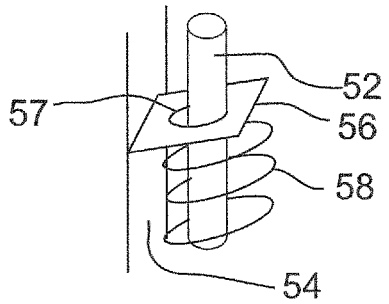
FIG. 5 is a perspective view illustrating a close up of a portion of the gate anchor of FIG. 1.

Anchor jack 50 may have suitable forms, such as a gate anchor as shown. Gate anchors are used with gates to lock the gate in position by digging into the ground or mating with a divot in a floor surface. Anchor jack 50 may be mounted on a bracket 54 mounted to a cross brace 80. A latch plate 56 is pivotally mounted to the bracket 54 and angled from perpendicular with the drive rod 52. Referring to FIG. 5, the latch plate 56 has a passage 57 for the drive rod 52, with a spring 58 biasing the latch plate 56 to pivot upwards to contact and frictionally restrict axial retraction of the drive rod 52. The rod 52 or latch plate 56 or both may be textured or contoured to promote latching in such a manner. As the rod 52 is advanced latch 56 forms an infinite ratchet that holds rod 52 in the extended position. To retract the rod, a user manually pivots latch plate 56 downwards against the biasing force of spring 58 to release the hold on rod 52, after which rod 52 may be retracted. Gate anchors may have more than one latch plate 56. Other suitable anchor jacks may be used, including hydraulic devices, such as hand operated hydraulic pumps, and mechanical jacks such as screw jacks, and others. Anchor jack 50 may be mounted on or as part of one or more of the legs 51, for example if jack 50 is part of a telescoping leg assembly (not shown).

Figure 6:
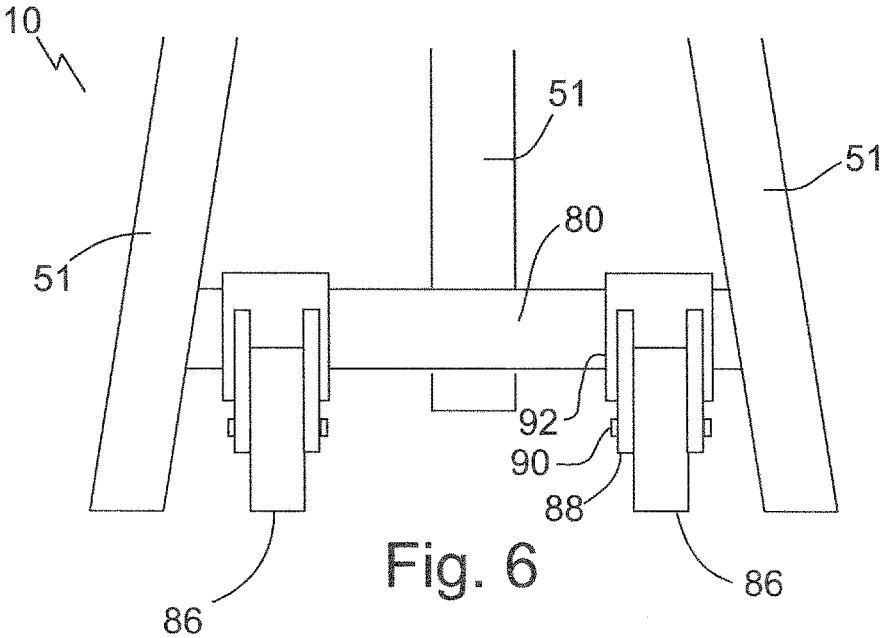
FIG. 6 is a side elevation view of the base of the structural frame of the support stand of FIG. 1.

Referring to FIGS. 1 and 6 one or more wheels 86 may be connected to frame 12. For example, FIGS. 1 and 6 illustrate that wheels 86 are extended laterally from a cross brace 80 between legs 51. In the upright position shown in FIG. 1, wheels 86 are positioned above but not in contact with the working surface 32 for safety reasons. Wheels 86 may contact surface 32 in the upright position in other cases, for example if ground engaging members 13 include wheels, although locks may be provided to prevent inadvertent lateral movement of stand 10. Wheels 86 may be located on the same side of the base 15 as is located jack 50 for safety reasons.

Referring to FIGS. 1A and 1-3 a method of connecting a downhole tool 16 and a downhole tubular 18 is illustrated. The specific example is the installation of a float shoe. Float shoes include rounded profile components that are attached to the downhole end of a casing string. An integral check valve in the float shoe prevents reverse flow, or U-tubing, of cement slurry from the annulus into the casing or flow of wellbore fluids into the casing string as it is run. The float shoe also guides the casing toward the center of the hole to minimize hitting rock ledges or washouts as the casing is run into the wellbore. The float shoe reduces hook weight. With controlled or partial fill-up as the string is run, the casing string can be floated into position, avoiding the need for the rig to carry the entire weight of the casing string. The outer portions of the float shoe may be made of steel and generally match the casing size and threads, although not necessarily the casing grade. The inside (including the taper) may be made of cement or thermoplastic, since such material must be drilled out if the well is to be deepened beyond the casing point.

In the example shown, the support stand 10 is used to accomplish the method. Referring to FIG. 1A, the context of the example is at an oil or gas well 20 site, where a drilling rig 24 includes a mast 22 set up over the well 20 by columns 33, and a downhole tubular 18 is suspended over a well bore 30 in a working surface 32, such as a rotary table as shown. Tubular 18 may be suspended by a travelling block 26 and drawworks 28 hanging from the mast 22. The support stand 10 is positioned with the ground engaging members 13 resting on working surface 32 adjacent well bore 30. In the example shown tubular 18 is a joint of casing string that will end up forming the downhole end of the casing string along with the tool 16.

Referring to FIG. 1, in a first stage, a downhole tool 16 such as a float shoe as shown, is positioned coaxially on a rotatable seat 14 (FIG. 1). The tool 16 may be positioned on seat 14 in a variety of ways. For example, the tool 16 may be manually lifted into the basket 44. In other cases tool 16 may be positioned by lifting the tool 16 onto the seat 14 using a hoist 81. Hoist 81 may be a barrel or drum lift, with a pair of clamps 83 as shown. Hoist 81 may be suspended off of mast 22 for example using a tagline (not shown). Each clamp 83 may grip a respective end 43 or 45 of the tool 16. In some cases the tool 16 may be rolled into the basket 44 when the basket is on the working surface 32, and the support stand 10 then rotated up into the standing position shown.

Referring to FIG. 2, once in basket 44, the tool 16 may be maneuvered into place on seat 14. The tool 16 may then be secured to the seat, for example with one or more locks such as radial clamps 36. Clamps 36 are advanced until they contact tool 16 from two, three, four or more equidistant radial points about tool 16 in the example shown, and clamps 36 may be further tightened to rigidly hold the tool 16 in place.

Referring to FIG. 2, in a second stage the seat 14 may be rotated to thread the downhole tool 16 to the downhole tubular 18. In some cases the support stand 10 may be positioned over the well bore 30, but this may not be possible. Thus, support stand 10 may need to be positioned adjacent the well bore 30. Because the tubular 18 is suspended over the well bore 30, the tubular 18 and the support stand 10 may need to be tilted to align tool 16 with tubular 18 sufficient to thread the two together. Thus, in the example shown at least the seat 14 is tilted relative to the working surface 32 and toward the downhole tubular 18.

Tilting is accomplished via two methods in the example. Firstly, the anchor jack 50 is extended to raise member 13A and angle basket 44 towards tubular 18. Direction arrow 90 illustrates the direction that ground engaging member 13A moves as the frame 12 is tilted. Tubular 18 may then be laterally swung into alignment with axis 34 by pushing tubular 18 in the direction specified by arrow 88. Secondly, the basket 44 may be manually rocked about axis 35 to make fine corrections to align tubular 18 and tool 16. Arrow 86 shows the path of an example rocking movement. At some point the basket 44 may be axially advanced, for example along direction arrow 94, or retracted using jack 76. For example, once tubular 18 and tool 16 are aligned the basket 44 may be jacked into contact so that threaded end 84 of tubular 18 stabs into box end 43 of tool 16.

Once aligned and in position, seat 14 may be rotated, for example by gripping handles 46 and spinning the basket 44 along the direction arrow 96. Care may be taken to avoid cross threading. As the tool 16 is threaded it will axially advance and axle 70 may rise out of contact with jack 76. Once the tool 16 is sufficiently threaded to tubular 18, the tool 16 may be unlocked, for example by retracting the radial clamps 36. The basket 44 and stand 10 may then be withdrawn and placed out of the way, and tubular 18 allowed to reposition in alignment with well bore 30. The connection between tubular 18 and tool 16 may be completed using a tool such as power tongs or hand operated tongs like a tong wrench. Loctite or other components may be used.

Figure 3:
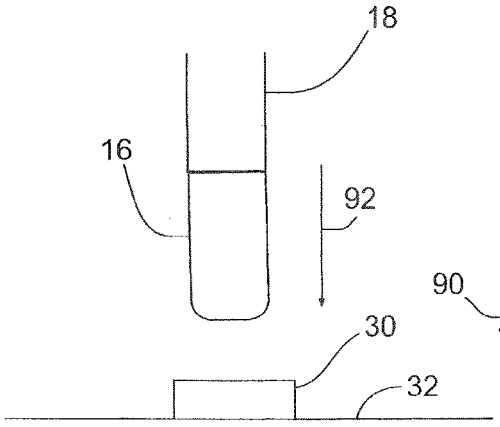

Referring to FIG. 3, once the tool 16 is installed the tubular 18 may be lowered into well bore 30 and into the well 20. Other components may be added prior to tubular 18, such as other float equipment as may be desired. Thus, although the above description refers to tool 16 being installed to a joint of tubing, the tubular 18 may in fact be another tool 16, such as another part of the float assembly.

A lateral door (not shown) may be provided in sidewall 48 of basket 44. The door may be used for various purposes such as reducing the need to lift the tool 16 up and over sidewall 48 into the basket 44, and making it easier to release the tool 16 and tubular 18 combination.

Well tubulars include coil, jointed, and casing tubing, as well as other downhole tools and components. Other names for tubing include drill pipe, jointed pipe and others. The word downhole refers to the fact that the tools and tubular are intended to be injected or lowered into a well and below a ground surface.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed as defined as follows:

1. A method of connecting a downhole tool and a downhole tubular, the method comprising:

positioning the downhole tool coaxially on a rotatable seat, which is defined by a base surface of a cage basket, with a sidewall of the cage basket extending above the base surface to encircle the downhole tool;

locking the downhole tool to the cage basket by securing a plurality of clamps, which are spaced radially about, and extend from, the sidewall of the cage basket, against sides of the downhole tool; and rotating the seat, using handles mounted to the cage basket, to thread the downhole tool to the downhole tubular.

2. The method of claim 1 further comprising unlocking the downhole tool to release the downhole tool.

3. The method of claim 1 in which, during rotating, the downhole tubular is suspended above the seat from a rig mast at a well.

4. The method of claim 1 in which the seat is mounted for rotation on a structural frame.

5. The method of claim 4 further comprising jacking up the seat relative to the structural frame.

6. The method of claim 4 in which the frame has a base with ground engaging members.

7. The method of claim 6 in which the ground engaging members rest on a working surface adjacent a well bore in the working surface, the downhole tubular is suspended above the well bore, and further comprising tilting at least the seat relative to the working surface and toward the downhole tubular.

8. The method of claim 7 in which tilting comprises tilting the structural frame by jacking up one or some of the sides of the base.

9. The method of claim 7 in which tilting comprising rocking the downhole seat relative to the structural frame.

10. The method of claim 1 in which positioning the downhole tool on the seat further comprises lifting the downhole tool onto the seat using a hoist.

11. A support stand comprising:

a structural frame with ground engaging members;

a cage basket having a base surface that forms a downhole tool seat, the cage basket being mounted for rotation on the structural frame about an axis of rotation, the downhole tool seat being coaxial with the axis of rotation;

radial clamps positioned in the sidewall of the cage basket for securing a downhole tool to the downhole seat; and handles mounted to the cage basket for permitting a user to, in use, manually rotate the cage basket to thread a downhole tool, secured on the downhole seat, to a downhole tubular.

12. The support stand of claim 11 further comprising an anchor jack mounted to or adjacent a side of the structural frame to tilt the structural frame.

13. The support stand of claim 11 in which the downhole tool seat is supported on the structural frame to rock to a varying degree about the structural frame.

14. The support stand of claim 13 in which the downhole tool seat is supported to rock using one or more spring elements.

15. The support stand of claim 11 in which the structural frame comprises a tripod.

16. The support stand of claim 11 further comprising a jack between the downhole tool seat and the structural frame.

17. A combination comprising the support stand of claim 11 and a downhole tool on the seat.

* * * * *